US006058729A

United States Patent [19]

Lifson et al.

[11] Patent Number: 6,058,729

[45] Date of Patent: May 9, 2000

[54] METHOD OF OPTIMIZING COOLING CAPACITY, ENERGY EFFICIENCY AND RELIABILITY OF A REFRIGERATION SYSTEM DURING TEMPERATURE PULL DOWN

[75] Inventors: Alexander Lifson, Manlius; Boris Karpman, Dewitt, both of N.Y.

[73] Assignee: Carrier Corporation, Farmington, Conn.

[21] Appl. No.: 09/108,787

[22] Filed: Jul. 2, 1998

[51] Int. Cl.[7] ..... F25B 41/04

[52] U.S. Cl. ..... 62/217; 62/196.1; 62/199; 62/228.1; 236/1 EA

[58] Field of Search ..... 62/228.1, 196.1, 62/199, 217; 236/1 E, 1 EA

[56] References Cited

U.S. PATENT DOCUMENTS 3,899,897 8/1975 Boerger et al. ..... 62/196
4,285,205 8/1981 Martin et al. ..... 62/113
5,582,022 12/1996 Heinrichs et al. ..... 62/175
5,768,901 6/1998 Dormer et al. ..... 62/175

*Primary Examiner*—Henry Bennett
*Assistant Examiner*—Marc Norman
*Attorney, Agent, or Firm*—Howard & Howard

[57] ABSTRACT

A unique method of operating a refrigeration system for rapidly pulling down a refrigerated container temperature includes the use and algorithm for operating several system components. The refrigeration system is preferably provided with a suction modulation valve, a compressor unloader and an economizer circuit. By utilizing each of these components in combination with one another, and at various stages during the pull down capacity and energy efficiency of the refrigeration system are optimized, while maintaining the system operation within preset limits.

13 Claims, 4 Drawing Sheets

METHOD OF OPTIMIZING COOLING CAPACITY, ENERGY EFFICIENCY AND RELIABILITY OF A REFRIGERATION SYSTEM DURING TEMPERATURE PULL DOWN

BACKGROUND OF THE INVENTION

This invention relates to a method of optimizing cooling, and balancing capacity, energy efficiency and reliability of a refrigeration system undergoing a process of temperature reduction in a refrigerated space.

In refrigeration of a container for carrying cargo, a refrigeration system is attached to cool a container and hold goods within the container at a target temperature. At any given point in time, the refrigeration system operating conditions are determined by several factors. As an example, the target point or set point temperature, the ambient temperature, the temperature inside the refrigerated container, and the electrical characteristics of the electrical power supply all effect the operating conditions. As these parameters change, so do the refrigeration system operating conditions.

Intermodal refrigeration containers are designed to transport goods upon various modes of transportation while a target temperature is maintained inside the container at all times. This type of refrigerated container is subject to particularly severe changes in all of the above-mentioned parameters.

The process of bringing the temperature of an initially warm load and container to a target temperature for an intermodal refrigerated container must occur under widely varying conditions in the above-mentioned parameters. This initial temperature reduction from an initial temperature to a target temperature is commonly referred to as temperature pull down. The power supply characteristics, target temperatures, and ambient temperature can vary greatly, as an example, from very low to very high temperatures. These varying parameters place special requirements on a refrigeration system for intermodal transport containers. While it is desirable to maximize the energy efficiency, the cooling capacity, and the reliability of the refrigeration system, it is often unrealistic to achieve all of these goals for the fixed configuration of a refrigeration system. Operating limitations are imposed on the refrigeration system by the hardware, refrigerant, and safety specifications. Each of these limitations create additional difficulties in maintaining a universal refrigeration system configuration that would satisfy all array of operating conditions that are typical encountered in a containerized refrigeration system. As an example, the maximum cooling capacity mode might not be very efficient in certain cases. Also, operational (i.g. electrical, etc.) limits may be exceeded during maximum cooling capacity operation.

When the refrigeration system utilizes a scroll compressor, there are limits which are particularly difficult to meet. As an example, the scroll compressors have limits on the motor current, discharge pressure, discharge temperature and suction pressure, all of which must be carefully monitored.

Thus, there is a need to create a method and algorithm for tailoring a refrigeration system to accommodate varying operating conditions while protecting the system from operation outside preset limits.

SUMMARY OF THE INVENTION

In one embodiment of this invention, a refrigeration system is operated in one of several possible modes according to a method that achieves optimum capacity, energy efficiency, and reliability of a refrigeration system at each stage of a temperature pull down process. To run the refrigeration system in its highest capacity mode immediately upon start-up might result in exceeding certain systems and/or compressor operational limits. The limits on the system must be carefully maintained to ensure high reliability of the system and compressor. On the other hand, certain energy efficiency sensitive applications may require operation of the compressor in a lower capacity mode to minimize overall energy consumption. A refrigeration system designer may achieve a desired trade-off between capacity, energy efficiency and reliability through proper selection of the operating modes of the inventive method.

In one embodiment of this invention, a refrigeration system is equipped with the necessary elements to allow for suction throttling, bypass unloading, and economizing. This system can be operated in one of several modes utilizing various combinations of the above-mentioned refrigeration system elements.

As an example, the system could be operated in six different modes. In a first mode, the refrigeration system is ran with the economizer circuiting, actuated, and neither bypass unloading or suction throttling activated. This is the highest capacity mode for most operation. A second mode includes utilization of the economizer circuit combined with suction throttling. This would typically result in a somewhat smaller system capacity. However, the compressor would still operate at a lower discharge pressure and current, which could be critical in cases where the discharge pressure or current operational limits would otherwise be exceeded.

A third mode is sometimes referred to as standard operation. None of the above-mentioned features are utilized. That is, the economizer circuit is deactivated, the bypass unloading is closed, and no suction throttling is provided.

The fourth mode is a combination of standard modes with suction throttling.

A fifth mode makes use of bypass unloading with neither suction throttling nor economizer circuit activation.

A sixth mode is a combination of bypass unloading with suction throttling. The sixth mode does not use economizing.

In one method of the present invention, a closed loop control strategy is imposed for utilizing the six above modes. The system is started in one of the higher numbered modes (i.e., sixth or fifth). As pull down progresses, the system operational limits are monitored (e.g., compressor current, discharge pressure, discharge temperature, etc.). If after a period of time all of the system parameters are below corresponding limits by a sufficient margin, the system is allowed to move to a lower numbered mode (e.g., third).

Using a similar tactic, the system will eventually arrive at its highest capacity mode, mode one. However, if at any time in the course of the pull down one of the system operational limits is exceeded, then the system moves back to a higher numbered mode.

Further, it is also possible to use an intermediate mode as a fallback position. That is, if the system is switched from mode six to mode three and one of the limits is then exceeded, the system may return to mode five, or in another variation, mode four. After operation in this fall back position for a period of time, if the system operating parameters are below corresponding limits by an acceptable margin, the system may again attempt another shift to a higher capacity mode. In this way, the system capacity and energy efficiencies are optimized while operational limits are not exceeded during the entire pull down process.

In a second embodiment of this invention, an open loop control strategy is utilized. This method utilizes prior knowledge of the system operation across the operating envelope. From experimentation or analysis, one can arrive at a control strategy that is directly derived from operating characteristics such as ambient temperature, refrigerated space, temperature, electrical power supply voltage, frequency, etc. Operation under this method automatically results in an, optimum trade off between capacity, energy efficiency and reliability, provided by a built in control algorithm.

These and other features of the present invention can be best understood from the following specification and drawings, the following of which is a brief description.

DETAILED DESCRIPTION OF A PREFERRED EMBODIMENT

Figure 1:
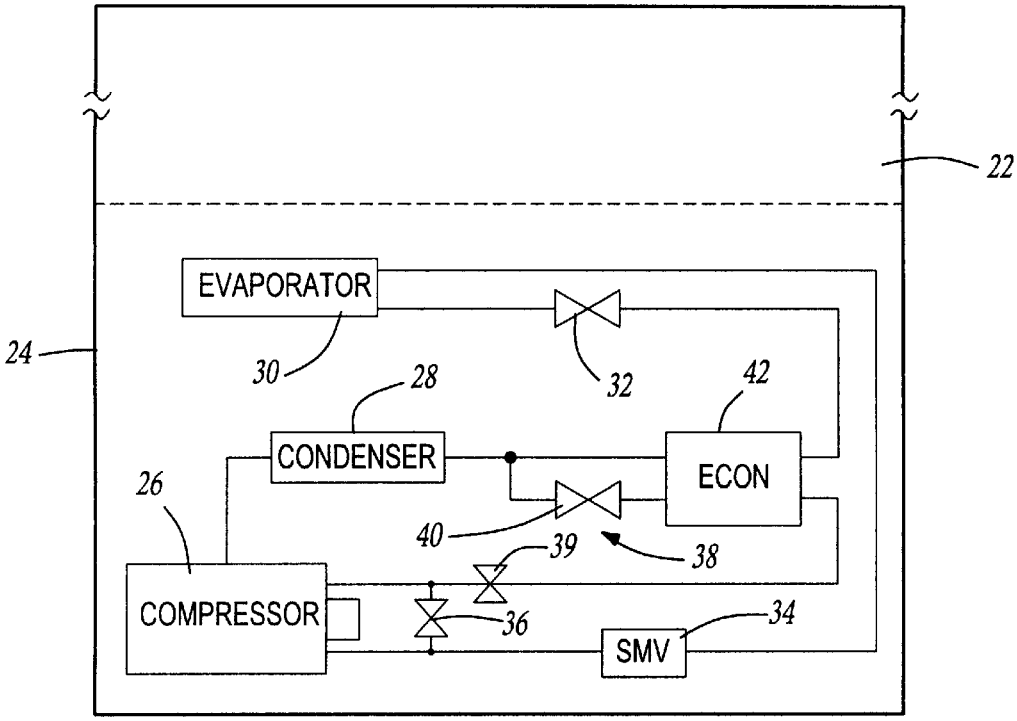
FIG. 1 is a schematic view of a container refrigeration system.

A refrigeration system 24 for cooling a refrigerated container 22 is illustrated in FIG. 1. The refrigeration system 24 incorporates a compressor 26, a condenser 28, an evaporator 30, and an expansion element 32 as known. These are the four main components of a typical refrigerant system. The refrigeration system 24 is also provided with a suction modulation valve 34 which is a known component that throttles the suction fluid leading to the compressor. An unloader bypass valve 36 connects partially or fully compressed refrigerant back to compressor suction. In this way, the unloader valve minimizes the load on the compressor and also minimizes the amount of fluid leaving the compressor. Unloader valves are known, and the unloader valve forms no portion of this invention. It is the use of the unloader valve at certain times within the method of this invention which is inventive. The same is true of the suction modulation valve.

In a most preferred embodiment, the unloader valve connects an economizer line back to the main suction line. This aspect of the invention is the subject of a co-pending patent application Ser. No. 09/114,395, now U.S. Pat. No. 5,996,364, owned by the assignee of this application.

An economizer circuit 38 includes an economizer line expansion element 40, an economizer heat exchanger 42 and an economizer line valve 39. Again, the economizer itself is not inventive. Instead, it is the use and interrelationship of the components of the refrigeration system 24 which is the inventive aspect of this invention.

Figure 2:
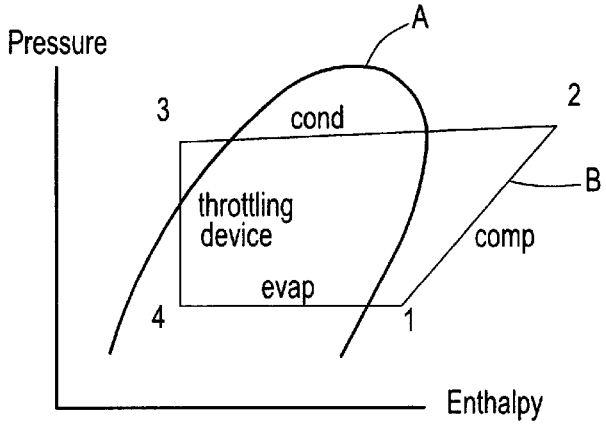
FIG. 2 is a diagram of a basic refrigeration cycle drawn in pressure-enthalpy coordinates.

FIG. 2 shows a saturation curve A and a refrigeration cycle curve B plotted on pressure-enthalpy coordinates. Saturation curve A represents the thermodynamic property of the refrigerant being used. Refrigerant cycle curve B represents the properties of the refrigerant circulating through the refrigeration system at various locations and points in the cycle.

The saturation curve separates the two phases (liquid-gas regions) under the saturation curve from the pure liquid region (upward and to the left of the curve), and a pure gas region (upward and to the right of the curve).

Point 1 of curve B corresponds to the thermodynamic state entering the compressor suction.

Point 2 of curve B corresponds to the thermodynamic state leaving the compressor discharge.

Point 3 corresponds to the thermodynamic state leaving the condenser and leaving the throttling device.

Point 4 corresponds to the thermodynamic state entering the evaporator or leaving the throttling device.

These four distinct processes constitute a basic refrigeration cycle. Refrigerant is compressed between state points 1 and 2. Energy in the form of heat is removed from the refrigerant between points 2 and 3 in a heat exchanger commonly referred to as a condenser. The condenser rejects heat into the surrounding environment. An adiabatic expansion across the throttling valve (or fixed restriction) takes place between points 3 and 4. Energy is absorbed by the refrigerant between the state points 4 and 1 in the form of heat in a heat exchanger commonly referred to as an evaporator. The evaporator removes heat from the condition space, such as the refrigerated container described above.

Figure 3:
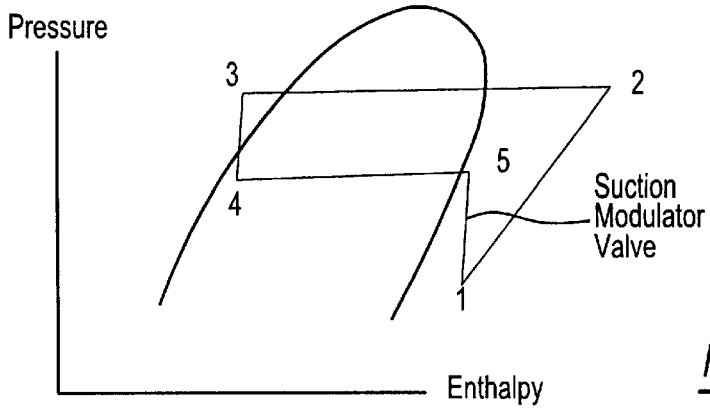
FIG. 3 shows the effect of bypass unloading on the pressure-enthalpy diagram.

FIG. 3 shows a modification of the basic refrigeration cycle shown in FIG. 2. In FIG. 3, a suction modulation valve is placed between the evaporator and the compressor.

As a result of the suction modulation valve operation an additional nearly adiabatic expansion process takes place between the outlet of the evaporator and the inlet to the compressor. The suction pressure is reduced and the compressor mass flow pumping capacity is decreased due to the higher specific volume of gas at lower suction pressure. This, in turn, decreases the system cooling capacity. The suction modulation valve is the element which is utilized to achieve the suction throttling in the modes described above.

Figure 4:
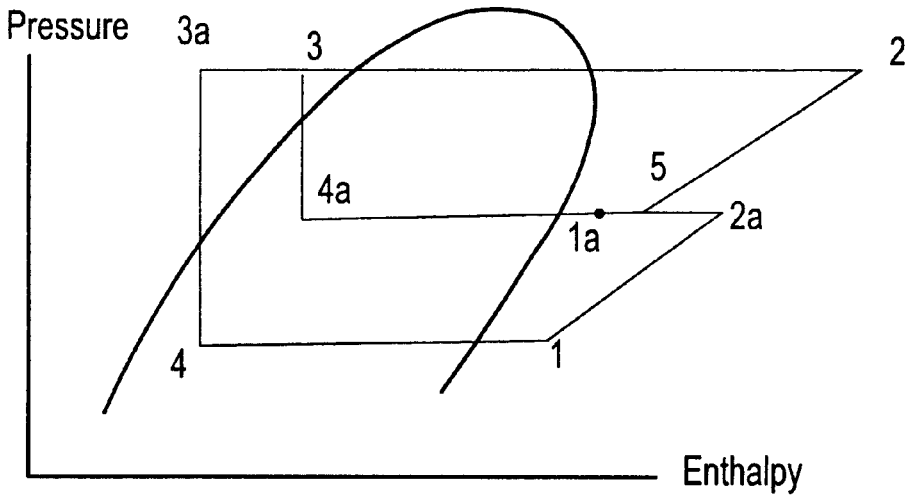
FIG. 4 shows the effect of economizing on a pressure-enthalpy diagram.

FIG. 4 shows a modification of the basic refrigeration cycled when an economizer circuit has been added. As in the basic refrigeration cycle, a low enthalpy refrigerant leaves the condenser at state point 3. The refrigerant flow is then split into an economizer (auxiliary) stream and an evaporator (main) stream.

The economizer stream undergoes an adiabatic expansion across a throttling device from point 3 to point 4A. The pressure is reduced to an intermediate pressure, corresponding to the condition at some intermediate point of the compression process. Then, both the auxiliary and main streams enter a heat exchanger commonly referred to as an economizer. The vapor in auxiliary stream evaporates at the intermediate pressure, and enters the compressor at some intermediate point of the compression process. As the vapor in auxiliary stream evaporates, the main stream is further subcooled between points 3 and 3A. As a result, the enthalpy of the main stream is further decreased and hence, the enthalpy difference between state points 4 and 1 is increased. The system cooling capacity is directly proportional to the enthalpy change in the evaporator, and thus the refrigeration system cooling capacity is increased by the use of the economizer circuit. As an additional cooling effect is achieved with only partial compression of the auxiliary stream, the overall energy efficiency is increased. The economizer circuit thus provides an additional cooling capacity in an energy efficient manner.

The present invention discloses a method for utilizing a combination of the economizer circuit, unloader bypass line, and a suction modulation valve to optimize capacity, energy efficiency and reliability of a container refrigeration system undergoing the temperature pull down process. Six example modes of operation are defined for the refrigeration system illustrated in FIG. 1. These modes are described in the Summary of the Invention section, and relate to the use of each of the three above-described elements alone or in combination.

Figure 6A:
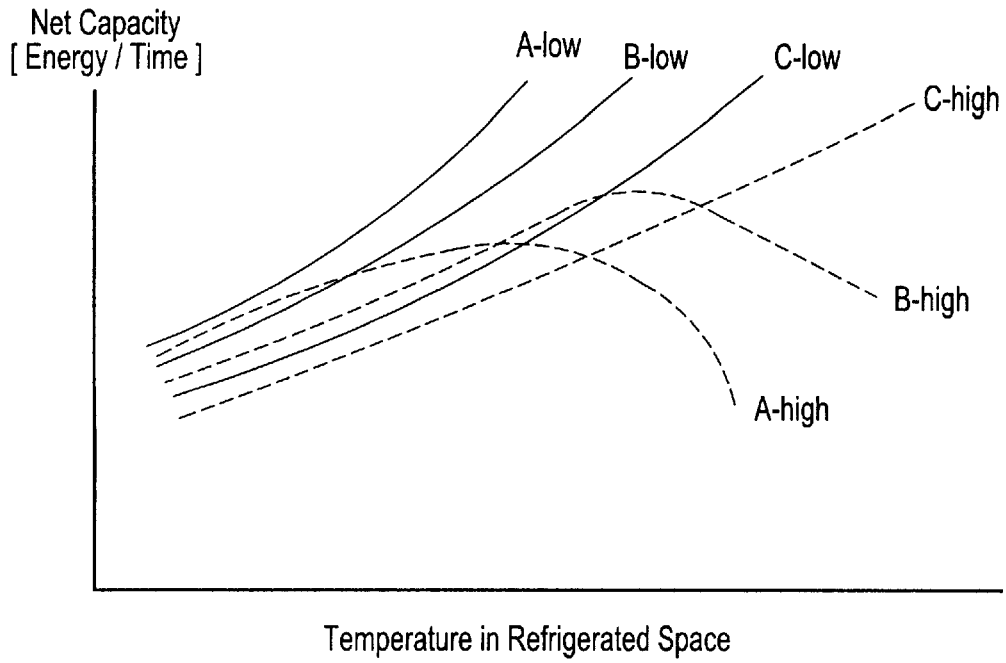
FIG. 6*a* is a capacity map of a typical refrigeration system.
Figure 6B:
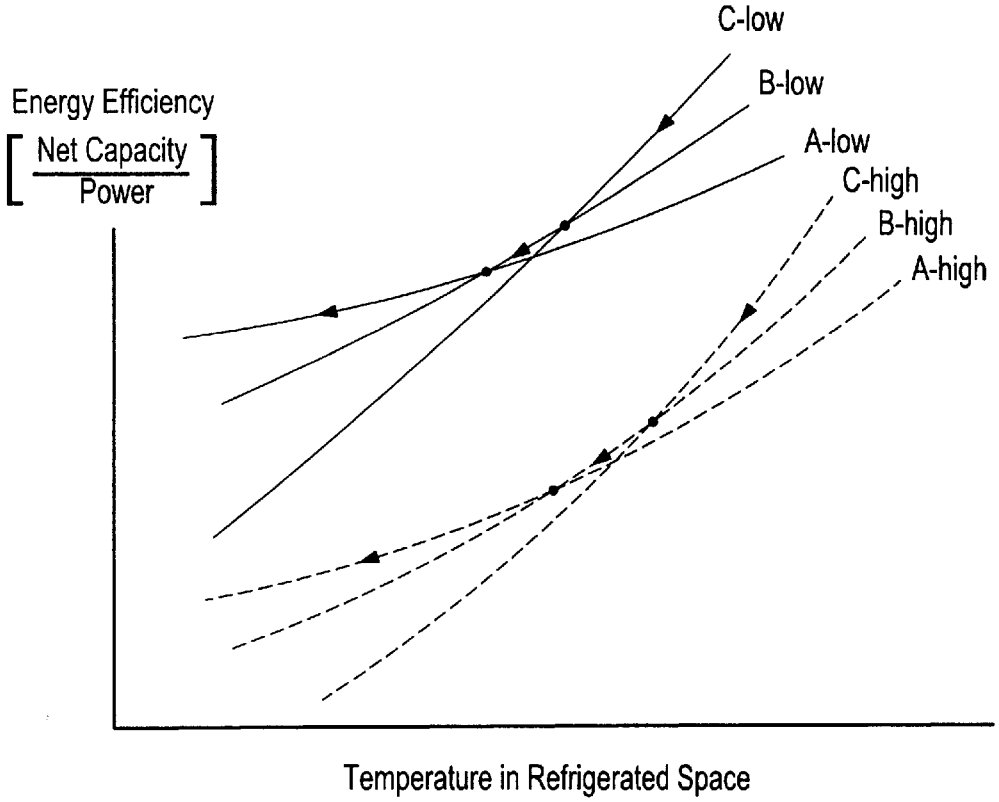
FIG. 6*b* is an energy efficiency map of a typical refrigeration system.

For understanding the methods discussed in this invention, FIGS. 6A and 6B should be studied. These figures show a refrigeration system net cooling capacity and energy efficiency, and how they are effected by modes of operation, ambient temperature, and controlled or refrigerated space temperature in a refrigeration system capable of operating in the six modes.

Lines A-low and A-high correspond to economized operation at low and high ambient temperature conditions. Lines B-low and B-high correspond to standard operation at low and high ambient temperatures, and line C-low and C-high correspond to unloaded operation at the low and high ambient temperature conditions. It is important to realize that each line includes the effect of suction throttling as required to maintain operational limits in these graphed conditions.

As can be seen from FIGS. 6A and 6B, low ambient temperature operation achieves the highest capacity when the refrigeration system is configured for economized operation. Note that the energy efficiency still varies with temperature inside the refrigerated space. The highest efficiency is achieved in an unloaded mode at higher temperatures, in a standard mode at intermediate temperatures, and in an economized mode at lower temperatures.

However, at high ambient temperatures, the highest capacity is no longer achieved with economized operation across the control temperature range. Unloaded operation delivers a maximum cooling at the high end of the temperature range, and standard mode provides the maximum cooling at a middle range of temperature. Finally, the economized mode is the highest capacity in the low end of the temperature range. As noted above, one might think that the highest capacity nominal operation, or economized operation, would result in the highest capacity across the ranges. These figures show that it is not the case.

Clearly, depending on the specific application goal, a refrigeration system designer can achieve a desirable trade-off between capacity and energy efficiency by assignment of the operation modes based upon various system characteristics, (e.g., ambient temperature, control temperature, compressor current, discharge pressure, etc.). This method is particularly well suited to refrigeration systems equipped with a microprocessor base controller that is able to continuously monitor the system operating parameters and control system devices according to a programmed logic.

Figure 5:
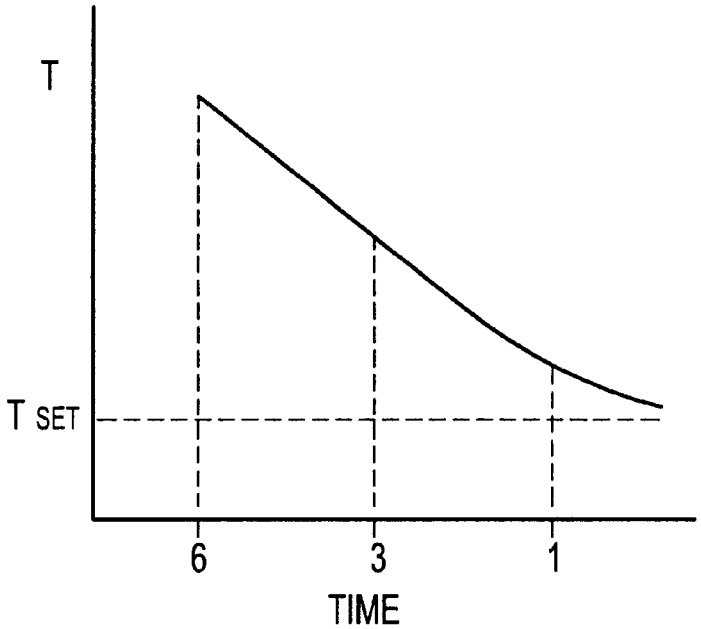
FIG. 5 shows the temperature in a refrigerated space versus the time for a typical pull down process.

The subject method of this invention is further understood by examining the temperature pull down process depicted in FIG. 5. FIG. 5 graphs the temperature inside refrigerated container (T) from the start of the process and until a set point Test is reached. The goal of the present invention is to achieve a desirable trade off between the time it takes to reach Test and the energy consumed by the refrigerant system, while maintaining the operation within all operational limits. In one method of the present invention, the system strives to achieve the highest capacity mode in the step up fashion such as described in the summary of the invention.

Figure 7:
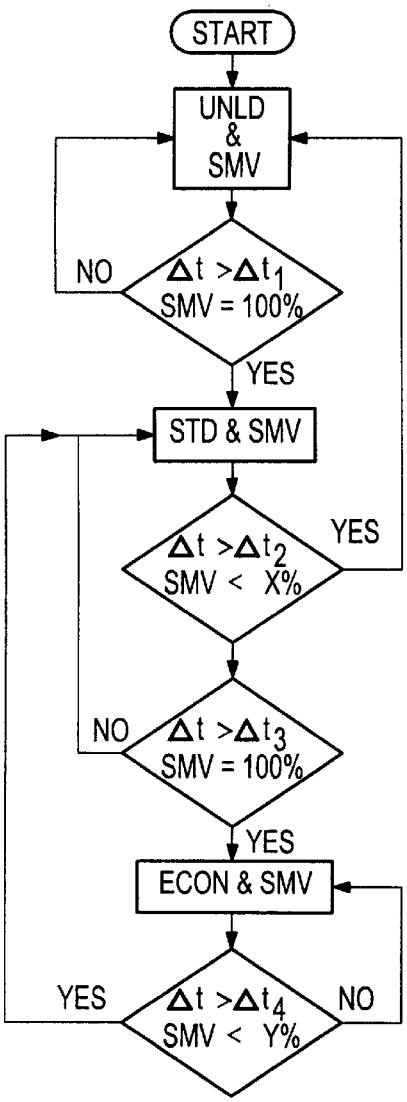
FIG. 7 is a flow chart for a closed-loop algorithm according to this invention.

FIG. 7 is a flow chart of one method of achieving the desired tradeoff between energy efficiency and net cooling capacity in the refrigeration system during a pull down process (while maintaining the system within set limits on all operating parameters) or the control scheme of closed loop type. This is a close-loop control scheme. As can be seen in FIG. 7, the controller is programmed to start the refrigeration system in a low capacity mode, such as unloaded mode, and while operating the suction modulation valve to maintain the system within the operational limits.

Operational limits (e.g. current draw, maximum discharge temperature, etc.) are set within the controller for each of several features. The compressor should not exceed these limits, as this would be undesirable, and could potentially damage the compressor. These limits are easily set by a system designer, and would vary from system to system. However, in the present invention the controller is provided with indications of what those limits are, and is able to compare the present operational parameters to these limits.

During the operation in mode 6, the suction modulation valve is fully opened over a period of time. This increases the capacity such that only the unloader is used. After a specified period of time at this condition, the controller attempts a transition to standard mode by closing the unloader. This mode is started with some throttling (i.e. in mode 4). If the transition is made to the standard mode, and the set period of time passes ($\Delta t_2$), the suction modulation valve position is checked. The suction modulation valve is controlled by a controller to maintain the system within the operational limits. The controller attempts to open the modulation valve towards fully open position, while maintaining operation within the limits. The suction modulation valve is thus desirably utilized through each phase of the pull down process to maintain the operation within the set limit. Thus, the position of suction modulation valve at any given time provides an indirect indication of the current operational mode status with respect to the operation limits. That is, as the system approaches an operational limit the suction modulation valve is slowly closed by the controller to bring the system back within the limits.

After the period of time, if the suction modulation position is less then some percent open (X%), the controller may then transition the refrigeration system back to a lower capacity mode. In the method described to this point, that lower capacity mode would be the unloaded mode.

Instead, if the suction modulation valve is open beyond the specified percentage, the system can then continue to operate in a standard mode until another set period of time $\Delta t_3$ expires. At that point, the controller may shift the system into economized mode, provided the suction modulation valve has reached a fully (or nearly fully) open position.

In the economized mode, the modulation valve is preferably still used initially. The controllers attempt to close the modulation valve, as described above. The controller again checks the suction modulation position after a set period of time $\Delta t_4$. If the suction modulation position is less than the specified opening (Y%), the controller will transition the system back to standard mode of operation. Otherwise, the refrigeration system will continue to operate in economized mode until pull down is complete. Thus, a configuration of the refrigerant system is effectively tailored to achieve a desired trade-off between net capacity and energy efficiency while maintaining the system within all operational limits.

Figure 8:
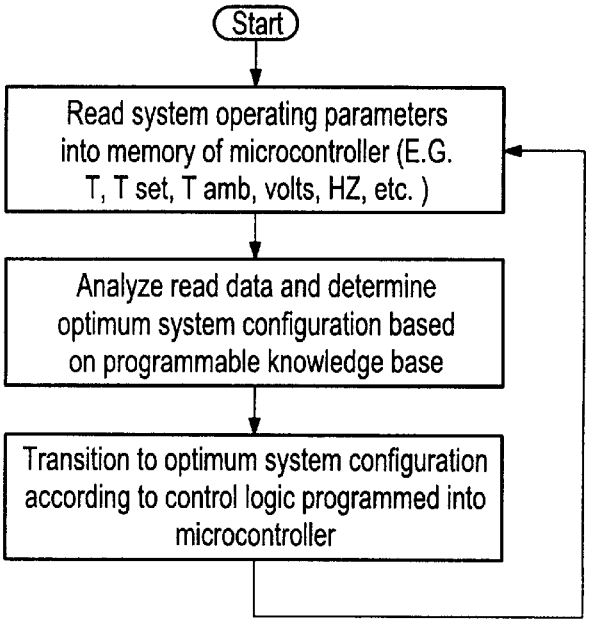
FIG. 8 is a flow chart for an open-loop control algorithm according to this invention.

FIG. 8 contains a flow chart for a second embodiment using an open loop control strategy. This method requires a mapping of the unit operation characteristics across the operating envelope. As an example, the net cooling capacity and energy efficiency can be arbitrarily, or experimentally, determined for all possible combinations of system modes and operating conditions. This would include a determination of the required amount of suction throttling to maintain the operational limits for all of the conditions. Once the mapping is complete, the unit configuration can be tailored to reflect upon the refrigeration system designer's goals. This can be better understood by examining FIG. 6A and 6B. In some applications where the maximum capacity is the driving factor, striving toward the economized operation within a certain amount of suction throttling could be the most reasonable approach. In applications which are sensitive to energy efficiency, the unloaded mode may be utilized across a relatively wide range of conditions at the expense of a reduced cooling capacity. Again, the control can be easily tailored to achieve a desired tradeoff.

In the present invention, the pull down operation of a refrigeration system is optimized to achieve a desired tradeoff between capacity and energy efficiency while all system operational limits are maintained. The present invention utilizes the operation of several system components in combination in a way, that has previously not been done. In addition, the present invention uses a logic for achieving the desired goal, again in a way which has not been utilized in the prior art.

Preferred embodiments of this invention have been disclosed, however, a worker of ordinary skill in the art would recognize that certain modifications come within the scope of this invention. For that reason, the following claims should be studied to determine the true scope and content of this invention.

What is claimed is:

1. A sealed refrigerated container comprising:

a refrigerated box;

a refrigeration system for cooling said box, said refrigeration system being provided with a compressor, evaporator, condenser, a throttle valve, an economizer circuit, a suction modulation valve, and an unloader valve for the compressor; and a control for said refrigeration system, said control being programmed to achieve a decrease in the temperature of said box by operation of said compressor, said unloader valve, said suction modulation valve and said economizer circuit according to a logic designed to balance energy efficiency and cooling capacity, said control including a series of modes of operation being defined from a nominally minimal capacity to a nominally highest capacity, and said control beginning to operate said refrigerant cycle at a mode with a nominally lower capacity and increasing to modes with nominally higher capacity as time passes.

2. A system as set forth in claim 1, wherein said control monitors operational limits during pull down.

3. A system as recited in claim 1, wherein the changing to increased modes occurs if the system operates in-a particular mode for a particular period of time without exceeding any operational limits.

4. A system as recited in claim 3, wherein said control operates said refrigeration system to return to a mode with a lower nominal capacity should a operational limit be exceeded during said predetermined period of time.

5. A system as recited in claim 4, wherein such system returns to a higher capacity mode after returning to the lower mode if an operational limit is not exceeded after the return.

6. A method of operating a refrigeration system for cooling a refrigerated container comprising the steps of (1) providing a refrigeration system for a sealed container, and providing circuit elements for said refrigeration system that allows said refrigeration system to be operated at modes of operation which are nominally of a higher capacity and a lower capacity than simple operation of said refrigeration system in a standard mode;

(2) beginning operation of said refrigeration system to begin cooling down said container at a mode which is nominally lower in refrigerant capacity than operation in a standard mode; and (3) increasing the operation through higher modes, until a mode is reached which is nominally higher than operation in said standard mode.

7. A method as recited in claim 6, wherein a control for the system begins operation in said nominally lower mode and after a period of time, if operational limits are not exceeded, moves toward a higher capacity mode, and if said limits are exceeded within a period of time, returns to a lower capacity mode.

8. A method as recited in claim 7, wherein said circuit is provided with a suction modulation valve, an economizer circuit, and a compressor unloader, and one of the modes of operation nominally above standard operation includes the use of said economizer in conjunction with said suction modulation valve.

9. A method as recited in claim 6, wherein said control looks to store preferred means of operation.

10. A method of operating a refrigeration system for a refrigerated container comprising the steps of:

(1) providing a refrigeration system including an unloader valve, a suction modulation valve, an economizer circuit, and a control which is operable to define six modes of operation by utilizing the suction modulation valve in conjunction with the unloader (mode 6), using only the unloader (mode 5), using only the suction modulation valve (mode 4), using none of the three elements (mode 3), using the economizer circuit with the suction modulation valve (mode 2), and using the economizer circuit (mode 1), and defining the six modes of operation as six through one, respectively;

(2) beginning operation of said refrigerant circuit in one of modes five and six for a period of time, and monitoring operational limits during said period of time, and if operational limits are not exceeded, increasing upwardly to one of modes 2, 3 and 4;

(3) operating the refrigeration system in said modes 2, 3, or 4 for a period of time and monitoring operational limits;

(4) if operational limits are not exceeded within said period of time, moving said refrigeration system to modes 1 or 2; and (5) moving from a lower number mode to a higher number mode should said operational limits be exceeded during any mode of operation.

11. A method as recited in claim 10, wherein said system begins in mode 5 or 6 in step (2), and moves to mode 3 in step (3), and then to mode 1 in step (4).

12. A method as recited in claim 11, wherein if a system maximum is exceeded in step (3), said system is returned to one of said modes 4 or 5.

13. A method as recited in claim 2, wherein if operation in step (4) at mode 1 exceeds operational maximums, said system moves back to mode 2 or 3.

* * * * *